US009106994B2

(12) United States Patent
Yu

(10) Patent No.: US 9,106,994 B2
(45) **Date of Patent: *Aug. 11, 2015**

(54) ULTRA-SLIM SPEAKER STRUCTURE

(71) Applicants: ABATECH ELECTRONICS CO., LTD., New Taipei (TW); Hsiang-Chih Yu, New Taipei (TW)

(72) Inventor: Hsiang-Chih Yu, New Taipei (TW)

(73) Assignee: Abatech Electronics Co., Ltd., New Taipei (TW)

( * ) Notice: Subject to any disclaimer, the term of this patent is extended or adjusted under 35 U.S.C. 154(b) by 54 days.

This patent is subject to a terminal disclaimer.

(21) Appl. No.: 13/831,269

(22) Filed: Mar. 14, 2013

(65) Prior Publication Data

US 2014/0270307 A1 Sep. 18, 2014

(51) Int. Cl.

| | |
|---|---|
| ***H04R 25/00*** | (2006.01) |
| ***H04R 7/06*** | (2006.01) |
| ***H04R 17/00*** | (2006.01) |
| *H04R 9/06* | (2006.01) |
| *H04R 7/04* | (2006.01) |

(52) U.S. Cl.

CPC ..... *H04R 7/06* (2013.01); *H04R 17/00* (2013.01); *H04R 7/04* (2013.01); *H04R 9/06* (2013.01)

(58) Field of Classification Search

USPC ..... 381/423, 190, 431, 150, 396

See application file for complete search history.

(56) References Cited

U.S. PATENT DOCUMENTS

| | | | | |
|---|---|---|---|---|
| 6,675,931 | B2 * | 1/2004 | Sahyoun | 181/157 |
| 2011/0064250 | A1 * | 3/2011 | Jeong et al. | 381/186 |
| 2011/0255718 | A1 * | 10/2011 | Fukushima et al. | 381/190 |

* cited by examiner

*Primary Examiner* — Davetta W Goins
*Assistant Examiner* — Amir Etesam
(74) *Attorney, Agent, or Firm* — Leong C. Lei

(57) ABSTRACT

A ultra-slim includes bass, alto membranes and acoustical element, where a surrounding embossed pattern is configured on a location adjacent to the rim of the bass membrane to form a dangling edge, and a frame stopping portion formed by a step is disposed on the center thereof. Whereby, a groove formed by a step is disposed on the center of alto membrane, and the acoustical element is formed by stacking a plurality of ceramic material layers together, thereby mounting the acoustical element on the alto membrane, and then lodging the alto membrane in the inner edge of the frame stopping element of the bass membrane to construct a thinned speaker in which sound is guided out through the bass and alto membranes after audio signals are received, capable of the application thereof to thinned products such as iPad, iPhone, cellular phones or notebook computers.

5 Claims, 6 Drawing Sheets

ULTRA-SLIM SPEAKER STRUCTURE

(a) TECHNICAL FIELD OF THE INVENTION

The present invention relates to a ultra-slim speaker structure, and more particularly to a ultra-slim speaker in which sound is guided out through alto, bass membranes after audio signals are received by an acoustical element, capable of the application to thinned products such as iPad, iPhone, cellular phones or, notebook computers, and more convenient manufacturing and assembly.

(b) DESCRIPTION OF THE PRIOR ART

General 3C products such as iPad, iPhone, cellular phones and tablets are developed gradually toward the ones of lightness, thinness, shortness and smallness due to the fast progress of the modern technologies such that parts used in the products must also be thinned. But, with respect to acoustical speakers and called number identification (CNI) vibration elements among them, the current speaker might achieve miniaturization, but cannot be lighter and thinner, causing the volume thereof to be difficult to conform with the requirements of products yet. Moreover, the reproduction of tweet, alto and bass must also be taken into consideration with respect to miniaturized speakers. Therefore, if the loss of audio frequencies is caused due to miniaturization, practitioners and consumers is really unable to accept it. Although one of the current thinned speakers can improve the above deficiencies a little, the manufacturing thereof is rather complex because an acoustical element must be fixed on a steel sheet during processes.

SUMMARY OF THE INVENTION

To improve the deficiencies mentioned above, and make the production and assembly of a thinned speaker to be more convenient, the present invention is proposed.

The main object of the present invention is to provide a ultra-slim speaker structure, allowing sound to be guided out through alto, bass membranes after audio signals are received by an acoustical element, capable of the application thereof to thinned products such as iPad, iPhone, cellular phones, or notebook computers, and achieving convenient manufacturing and assembly and better acoustical effect.

A ultra-slim speaker structure includes a bass membrane, alto membrane and acoustical element, where a surrounding embossed pattern is configured on a location adjacent to the rim of the bass membrane to form a dangling edge, and a frame stopping portion formed by a step is disposed on the center thereof. The area of the alto membrane is approximately equal to the area surrounded by the inner edge of the frame stopping portion of the bass membrane. Furthermore, a groove formed by a step is disposed on the center of the alto membrane, and the acoustical element is formed by stacking a plurality of ceramic material layers together, thereby mounting the acoustical element on the alto membrane, and then lodging the alto membrane in the inner edge of the frame stopping element of the bass membrane to construct a thinned speaker in which sound is guided out through the bass and alto membranes after audio signals are received, capable of the application thereof to thinned products such as iPad, iPhone, cellular phones or notebook computers.

In the ultra-slim speaker structure, the bass membrane is made from polyethylene (PE), polycarbonate (PC) or the same.

In the ultra-slim speaker structure, the alto membrane is made of silk fabric, paper embryo, wood sheet, foam, or the like.

DETAILED DESCRIPTION OF THE PREFERRED EMBODIMENTS

Figure 1:
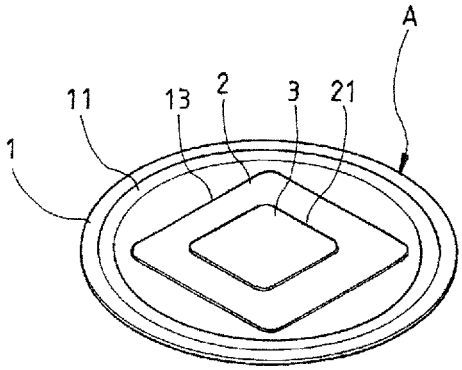
FIG. 1 is a perspective view of the present invention.
Figure 1A:
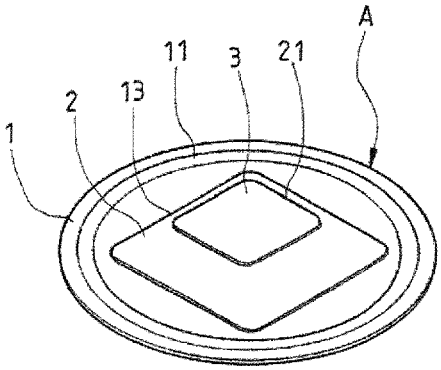
FIG. 1A is another perspective view of the present invention.
Figure 2:
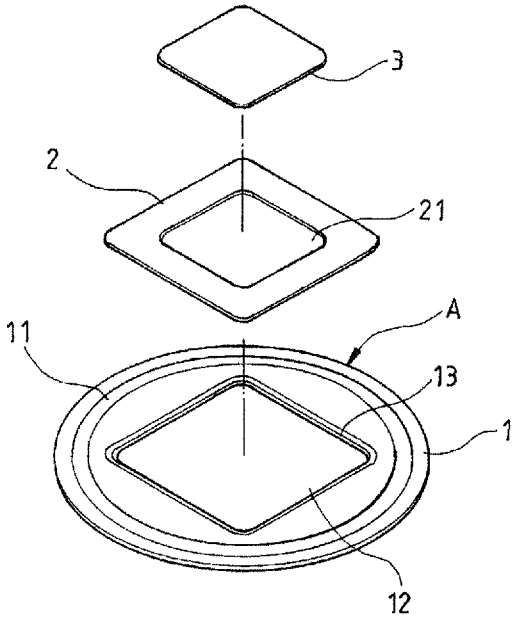
FIG. 2 is an exploded view of the present invention.

Referring to FIGS. 1, 1A and 2, which respectively are a perspective view, perspective view and exploded view of the present invention, a ultra-thin speaker structure of the present invention includes a bass membrane 1, alto membrane 2 and acoustical element 3. In a preferred embodiment, the bass membrane 1 is a circular body made from polyethylene (PE), polycarbonate (PC), or the same, where a surrounding semicircular embossed pattern is configured on a location adjacent to the rim thereof, thereby to form a dangling edge 11, and a square opening 12 is disposed on the center thereof, where a frame stopping portion 13 constituted by a step is disposed on the square opening 12.

The alto membrane 2 is made of silk fabric, paper embryo, wood sheet, foam, or the same, and the area of the alto membrane 2 is approximately the same as the area surrounded by the inner edge of the frame stopping portion 13 of the bass membrane 1, and a groove 21 formed by a step is disposed on the center of the alto membrane 2.

The acoustical element 3 is formed by stacking a plurality of ceramic material layers together.

A thinned speaker A is constituted by combining the above components together, namely, placing the acoustical element 3 on the groove 21 of the alto membrane 2, and then lodging the alto membrane 2 in the inner edge of the frame stopping portion 13 of the bass membrane 1 plus soldering a conducting wire on the acoustical element 3 to form the thin speaker A. Sound can be guided out through the alto membrane 2 and bass membrane 1 after audio signals are received by the acoustical element 3 such that the present invention can further be applied to thinned products such as iPad, iPhone, cellular phones and notebook computers. In addition, the acoustical element 2 may be configured on any position of the alto membrane 2 deviating outward from the center thereof besides on the center thereof, sound can also be guided out through the alto membrane 2 and bass membrane 1 after audio signals are received.

Figure 3:
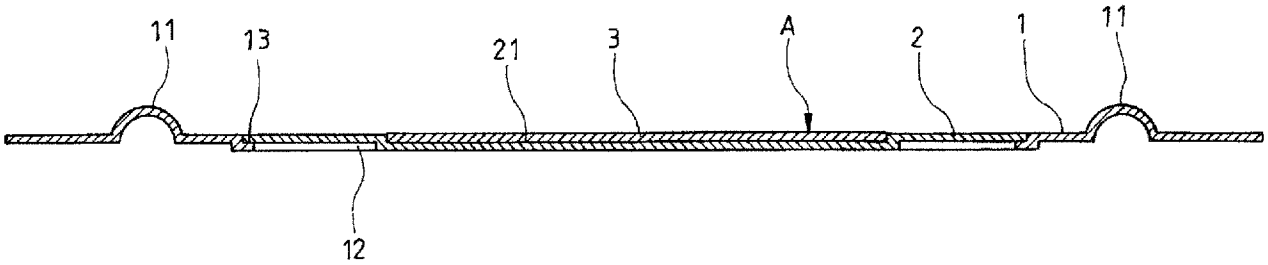
FIG. 3 is a cross sectional view of the present invention.

Referring to FIG. 3, which is a cross sectional view of the present invention, upon the assembly of the present invention, the acoustical element 3 is mounted on the groove 21 of the alto membrane 2, and the alto membrane 2 is lodged in the inner edge of the frame stopping portion 13 of the bass membrane, allowing the assembly to be more convenient through the positioning of the groove 21 and the frame stopping portion 13. Whereby, sound may be guided out through alto membrane 2 and bass membrane 1 without causing the loss of audio frequencies after the audio signals are received by the acoustical element 3 disposed on the alto membrane 2. In addition, the elastic wave action of a general speaker can be formed to reduce harmonic distortion, and further to allow the thinned speaker A to generate better sound quality due to the dangling edge 11 formed by disposing the surrounding semicircular embossed pattern on the location adjacent to the rim of the bass membrane 1.

Figure 4:
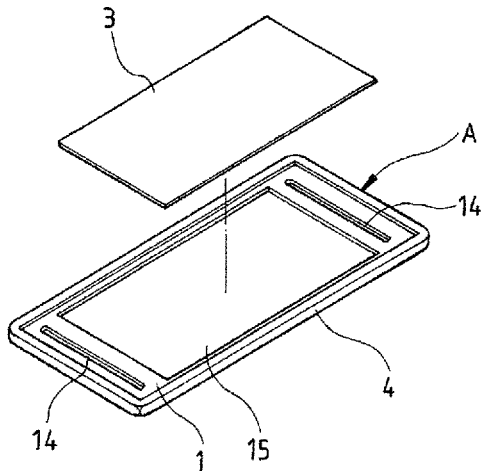
FIG. 4 is an exploded view of another preferred embodiment of the present invention.
Figure 5:
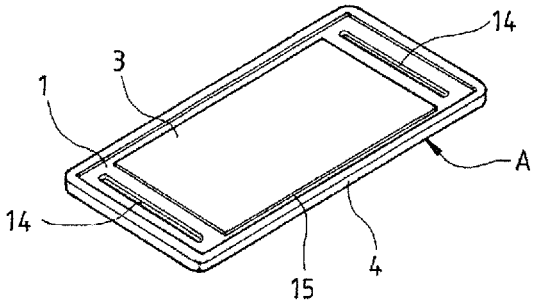
FIG. 5 is a perspective view of another preferred embodiment of the present invention.

Referring to FIGS. 4 and 5, which respectively are an exploded view and perspective view of another preferred embodiment according to the present invention, in this embodiment, the circular construction is excluded. A thinned speaker structure includes a bass membrane 1, acoustical 3 and frame 4, where the bass membrane 1 is rectangular, allowing the bass membrane 1 to be fixed on the frame 4, and a bar-typed semicircular embossed pattern is respectively configured on two positions adjacent to respective transversal rims of the bass membrane 4, thereby forming a dangling edge 14. In addition, a groove 15 formed by a step is disposed on the center of the bass membrane 1

The acoustical element 3 is forced by stacking a plurality of ceramic material layers together.

A thinned speaker A is constituted by combining the above components together, namely, placing the acoustical element 3 on the groove 15 of the bass membrane 1, and soldering a conducting wire on the acoustical element 3 to form the thinned speaker A. Sound can be guided out through the bass membrane 1 after audio signals are received by the acoustical element 3 such that the present invention can further be applied to thinned products such as iPad, iPhone, cellular phones and notebook computers.

Figure 6:
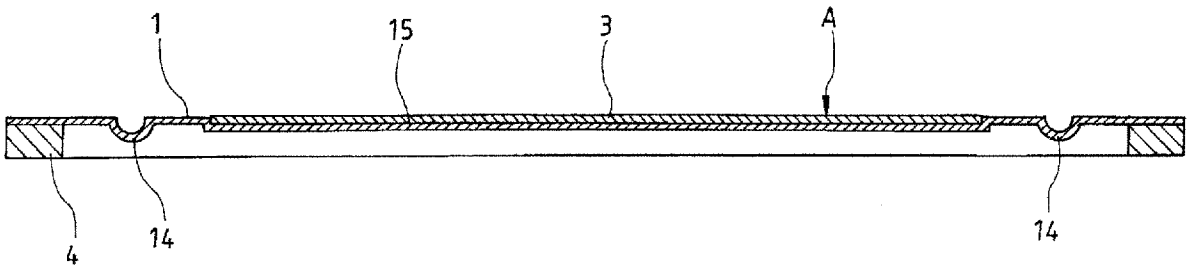
FIG. 6 is a cross sectional view of another preferred embodiment of the present invention.

Referring to FIG. 6, which is a cross sectional view of another preferred embodiment according to the present invention, upon the assembly of this embodiment, the acoustical element 3 is mounted on the groove 15 of the bass membrane 1, allowing the assembly to be more convenient through the positioning of the groove 15. Whereby, sound can be guided out through the bass membrane 1 without causing the loss of audio frequencies after audio signals are received by the acoustical element 3. In addition, the elastic wave action of a general speaker can be formed to reduce harmonic distortion, and further to allow the thinned speaker A to generate better sound quality due to the dangling edges 14 formed by disposing the bar-typed semicircular embossed pattern on the locations adjacent to the rim of the bass membrane 1.

Comparing with the prior arts, the present invention at least has the following advantages:

1. the present invention is more thinned such that the application range thereof is broader.

2. alto and tweet is not distorted, and the effect of reproduction of the original is better by mounting the acoustical element 3 on the alto membrane 2 and bass membrane 1 to generate sound.

3. the alto membrane 2 can compensate the sound loss of the bass membrane 1, enabling the whole sound guiding effect to be more stable. In addition, the bass guiding effect of the bass membrane 1 is good, capable of reaching 300 Hz, allowing the bass not to be lost.

4. the dangling edge 14 adjacent to the rim of the bass membrane 1 can form an elastic wave action like a general speaker does to reduce harmonic distortion, and further to allow the thinned speaker to genera to better sound quality.

I claim:

1. An ultra-slim speaker structure, comprising:

a bass membrane, a surrounding semicircular embossed pattern being configured on a location adjacent to a rim thereof to form a dangling edge, and a square opening with a frame stopping portion constituted by a step being configured on a center thereof;

an alto membrane, lodged in an inner edge of said frame stopping portion of said bass membrane, a groove formed by a step being disposed on a center thereof; and an acoustical element, formed by stacking a plurality of ceramic material layers together, sound being guided out through said alto membrane and bass membrane after audio signals are received by said acoustical;

wherein the acoustic element is completely received in the groove of the alto member in such a way that a top face of the acoustic element is substantially flush with a top face of the alto membrane, which is in turn substantially flush with a top face of the bass membrane and a bottom face of the alto membrane is substantially flush with a bottom face of the bass membrane.

2. The structure according to claim 1, wherein an area of said alto membrane is approximately the same as an area surrounded by an inner edge of said frame stopping portion of said bass membrane, allowing said alto membrane to be lodged in said inner edge of said frame stopping portion.

3. The structure according to claim 1, wherein said bass membrane is made from polyethylene (PE) or polycarbonate (PC).

4. The structure according to claim 1, wherein said alto membrane is made of silk fabric or paper embryo.

5. The structure according to claim 1, wherein said alto membrane is made of wood sheet or foam.

* * * * *